US006655735B1

(12) United States Patent
Learning

(10) Patent No.: US 6,655,735 B1
(45) Date of Patent: Dec. 2, 2003

(54) WATERPROOF/BREATHABLE ODOR-RESISTANT SEAT COVER

(76) Inventor: Thomas W. Learning, P.O. Box 725027, Atlanta, GA (US) 31139

( * ) Notice: Subject to any disclaimer, the term of this patent is extended or adjusted under 35 U.S.C. 154(b) by 0 days.

(21) Appl. No.: 09/500,880

(22) Filed: Feb. 9, 2000

Related U.S. Application Data

(60) Provisional application No. 60/119,770, filed on Feb. 11, 1999.

(51) Int. Cl.[7] ..... A47C 31/00
(52) U.S. Cl. ..... 297/228.1; 297/229
(58) Field of Search ..... 297/229, 219.1, 297/219.12, 228.1, 228.11

(56) References Cited

U.S. PATENT DOCUMENTS

| | | | | | |
|---|---|---|---|---|---|
| 3,504,941 | A | * | 4/1970 | Gerald | 297/228.1 |
| 3,884,355 | A | | 5/1975 | Erickson | |
| 3,892,440 | A | | 7/1975 | Dudley | |
| 4,396,227 | A | * | 8/1983 | Neilson | |
| 4,400,030 | A | * | 8/1983 | Maruzzo et al. | |
| 4,669,779 | A | * | 6/1987 | Kaganas et al. | 297/229 |
| 4,676,376 | A | | 6/1987 | Keiswetter | |
| 5,005,901 | A | | 4/1991 | Hinde | |
| 5,023,125 | A | * | 6/1991 | Gray | 297/228.1 X |
| 5,234,252 | A | * | 8/1993 | Wallach | 297/229 |
| 5,265,933 | A | * | 11/1993 | Croshaw | 297/229 X |
| 5,618,082 | A | | 4/1997 | Jachmich | |
| 5,674,513 | A | * | 10/1997 | Snyder, Jr. et al. | 424/404 |
| 5,709,431 | A | | 1/1998 | Horn | |
| 5,791,732 | A | | 8/1998 | Lucree | |
| 5,803,539 | A | | 9/1998 | Dewars et al. | |
| 5,806,925 | A | * | 9/1998 | Hanley | 297/229 |
| 5,843,556 | A | | 12/1998 | Levas | |
| 5,846,604 | A | | 12/1998 | Caldwell | |
| 6,050,639 | A | * | 4/2000 | Horn | 297/228.1 X |
| 6,067,777 | A | * | 5/2000 | Stoll | 297/228.1 X |

* cited by examiner

*Primary Examiner*—Peter R. Brown
*Assistant Examiner*—Stephen Vu
(74) *Attorney, Agent, or Firm*—Myers & Kaplan, L.L.C.; Joel D. Myers

(57) ABSTRACT

A nonabsorbing protective seat cover having a seat portion and a back portion, comprising a water-impermeable and gas-permeable layer laminated to a non-absorbent non-woven layer, whereby the nonabsorbing protective cover resists absorption of liquid contaminates from the user, hydrophobically repels liquid contaminants introduced thereto and protects the vehicle seat from damage.

2 Claims, 2 Drawing Sheets

WATERPROOF/BREATHABLE ODOR-RESISTANT SEAT COVER

CROSS REFERENCE TO RELATED APPLICATIONS

This application is entitled to the benefit of Provisional Patent Application Serial No. 60/119,770 filed: Feb. 11, 1999.

BACKGROUND

1. Field of Invention

This invention relates to using a cover to protect seats including vehicle seats and other furniture.

2. Description of Prior Art

The closest known prior art are car seat covers. Existing car seat covers have been primarily designed to improve comfort or appearance or to provide a protective barrier for the seat. A sheepskin seat cover is an example of a seat cover designed to improve comfort. Wooden bead and wire mesh seat covers are seat covers designed to improve comfort. A universal fit velour seat cover is an example of a seat cover designed to improve appearance and provide a measure of protection to the car seat. None of these seat covers provides an effective solution to protecting the seat from sweat, water, snow, mud, dirt and other contaminants and yet is easy to install and remove, is washable, comfortable, resists odors, is easy to manufacture, seldom needs laundering, and is aesthetically pleasing.

A sheepskin or cloth seat cover will not protect the car seat from sweat or moisture that can soak through the seat cover to the car seat. Furthermore, since they absorb moisture they will foster odors. Wooden bead or wire mesh seat covers do not protect the underlying car seat from moisture, sweat, snow, mud, dirt, or other contaminants.

Plastic film seat covers, such as described by Keiswetter in U.S. Pat. No. 4,676,376, protect the seat from moisture, sweat, dirt and other contaminants, however they are not comfortable or aesthetically pleasing.

Some cloth car seat covers are treated with Scotchguard or other treatments to repel water. This will help, but will not prevent water or sweat from passing through the seat cover. Water or sweat that passes through the seat cover will lead to deterioration of the seat and cause odor problems.

Many existing car seat covers, such as cloth or sheepskin seat covers, will have odor problems if they are saturated with sweat or water because they are not designed to avoid the absorption of moisture. After they absorb moisture, they have no mechanism for stopping the growth of microorganisms that lead to odor problems. Nor are they quick drying.

Most existing car seat covers are cumbersome to install and remove. By implementing a series of hooks, straps, flaps, and drawstrings that are designed to securely attach the seat cover to the seat they become difficult to install and remove. some seat covers take as long as a half-hour to install or remove. Furthermore, they are not signed to be used on a variety of seats other than vehicle seats or on a flat surface.

Jachmich in U.S. Pat. No. 5,618,082 describes a terry cloth seat cover that can be quickly installed and removed from an automotive seat. Since this seat cover is not waterproof it will not adequately protect the seat from sweat, moisture, snow, mud, oil or other contaminants that may soak through the terry cloth. Furthermore, since the seat cover is designed with an opening to go around the headrest, the headrest is not protected from sweat, moisture and other contaminants.

Hanley in U.S. Pat. No. 5,806,925 describes a waterproof, breathable seat cover that protects the seat, however it is not simple to manufacture. The patent specifies an absorbent upper layer that will increase drying time for the product, will foster odors and will require frequent washings. Therefore, the cover envisioned by Hanley will not be convenient or readily available because it will need to be removed from the vehicle due to the accumulation of odors especially when used after physical exertion or during hot or humid weather. Furthermore, by requiring the construction of a complex three-layer design, material costs and the amount of labor required to manufacture the seat cover are excessive.

Therefore, a seat cover does not exist which is comfortable, attractive, easy to use, easy to manufacture, waterproof, breathable, non-absorbent, quick-drying, odor-resistant and avoids the need for laundering.

SUMMARY

A seat cover comprising a water-impermeable/gas-permeable material that is hydrophobic and non-absorbent. In the preferred embodiment, a pocket at the top of the seat cover is used to attach the seat cover to the back of a seat.

OBJECT AND ADVANTAGES

To provide a cover which can be used to protect a seat from sweat, dirt, moisture, snow, mud and other contaminants. The cover is liquid impermeable to protect the seat. The cover is gas-permeable to make the cover more comfortable and to facilitate evaporation of any surface moisture when cover is bunched or folded for storage. Since the cover is gas-permeable, the user will be comfortable even when using the cover while wet or sweaty. The cover is quick and easy to use. Furthermore, the material is hydrophobic and non-absorbent, which prevents odors by substantially eliminating the amount of retained moisture in order to reduce the growth of microorganisms. The material may be treated with an anti-microbial agent. The cover will be machine-washable. The cover can be used to protect car seats, chair seats, sofas, beds or carpets. It can also be placed on dirty or wet objects in order to protect the user from getting dirty or wet, for example it could be placed on the ground.

DRAWING FIGURES

REFERENCE NUMERAL IN DRAWINGS

| | |
|---|---|
| 10 | seat cover |
| 11 | angular design |
| 12 | pocket |
| 14 | seat back |
| 16 | seat cushion |
| 18 | headrest |
| 20 | waterproof/breathable layer |
| 22 | hydrophobic, non-absorbent layer |

DESCRIPTION

A preferred embodiment of the seat cover is illustrated in FIGS. 1, 2, 3 and 4. The seat cover 10 is made of a water-impermeable/gas-permeable, hydrophobic, non-absorbent laminate material in a largely rectangular shape. The seat cover is large enough to cover the back and seat surfaces of a seat. That is, the surfaces of the seat that would be in contact with the head, back, posterior and legs of the user. Such a seat cover is currently marketed as SeatShield™ to people who engage in sports, exercise and outdoor activities. SeatShield™ is sold through a variety of channels including race expositions, sporting goods stores and e-commerce.

In the preferred embodiment, the seat cover 10 would be made of a laminate material containing a waterproof/breathable layer laminated to one or more hydrophobic, non-absorbent non-woven layers such as SMS, spunbond-meltblown-spunbond composite which is made by Kimberly Clark of Neenah, Wis., and others. Other materials with waterproof/breathable and non-absorbent characteristics could be used. Based on customer feedback the degree of water resistance of the material for some applications will need to be sufficient to block moisture from a person who is very wet, such as after swimming, or who is continuing to sweat for a long period of time such as exhibited after running. In which case a material containing porous polypropylene film such as Aptra manufactured by BP Products would be appropriate. The degree of hydrostatic resistance of a material can be tested using a Mullins Burst Tester.

The seat cover material could be treated with an anti-microbial agent. One method for applying an anti-bacterial agent is taught in U.S. Pat. No. 5,674,513 by Snyder. The material would be machine washable. The top surface of the material would be hydrophobic and non-absorbent. In an alternative embodiment the surface of the material would be absorbent.

Figure 1:
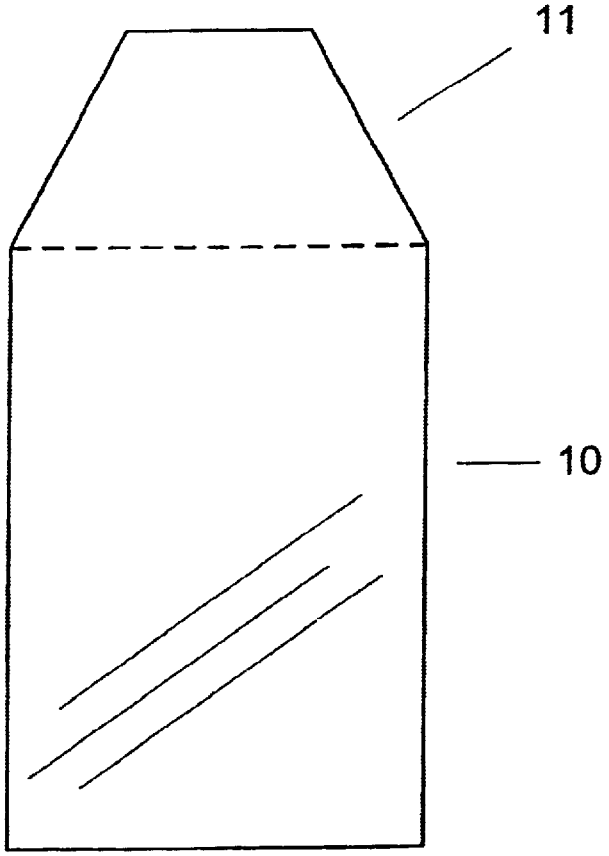
FIG. 1 shows a front view of a seat cover made with a waterproof/breathable laminate material that is hydrophobic and non-absorbent.
Figure 2:
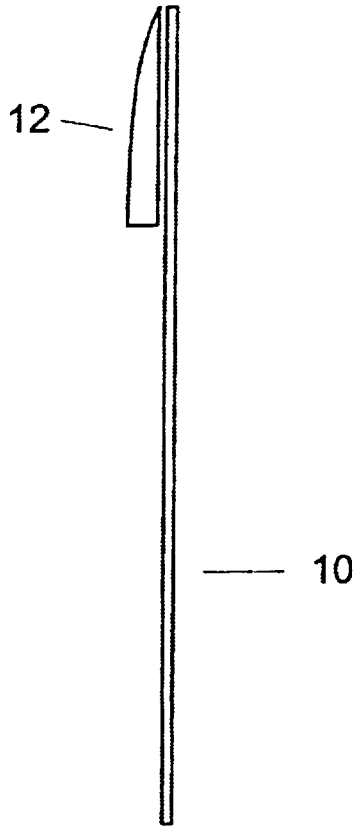
FIG. 2 shows the seat cover from a side view that emphasizes a pocket that is designed to slip over the back of a seat or chair.

FIG. 2 shows the pocket 12 that is made on the top back portion of the seat cover. The pocket 12 is made by attaching material to the top of the back of the seat cover. The pocket 12 is attached along the top edge of the seat cover and along each side edge. Pocket 12 is not secured along the bottom edge so that a pocket is formed. The pocket can then be slipped over the top of a seat or over a headrest that is attached to, or part of the seat. In the preferred embodiment the side edges of pocket 12 are formed in an angular manner to prevent excess material from being inconvenient to the user if slipped over a headrest of a car seat and to provide a better fit on most seats. The pocket 12 could be attached to the seat cover 10 by sewing, adhesives, heat, ultrasound or other method of attachment. The pocket 12 could be made of a different material than the seat cover 10 or it could be made of the same material. The pocket 12 could also be made by folding over the top portion of the seat cover 10 and securing the sides of pocket 12 by sewing, adhesives, heat, ultrasound or other method of attachment.

The edges of seat cover 10 could be left unfinished or edged with an overlocking stitch using a serger. Alternatively, the edges of seat cover 10 could have banding attached or the edges of seat cover 10 could be folded over and secured with either sewing, adhesives, heat, ultrasound or other means of attachment.

Figure 3:
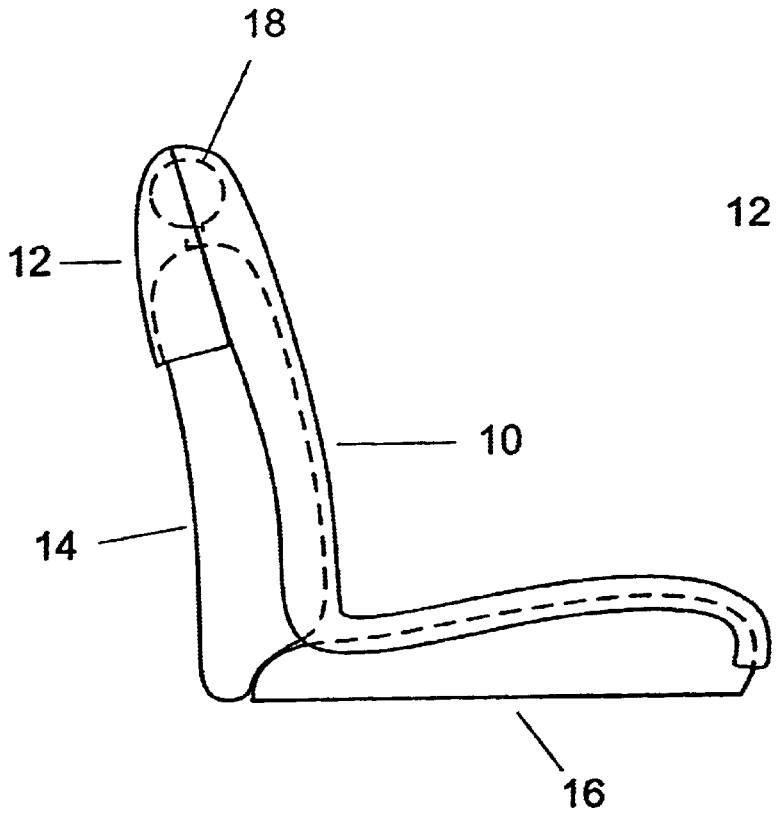
FIG. 3 shows the seat cover in use on an automotive seat.

FIG. 3 shows the seat cover 10 in use on an automotive seat. The pocket 12 fits over the headrest 18 and the upper portion of the seat back 14. The lower portion of seat cover 10 is positioned over the top of seat cushion 16. Seat cover 10 has sufficient dimensions to slightly overlap the edges of the seating surfaces in contact with the user to provide extra protection to the seat.

Figure 4:
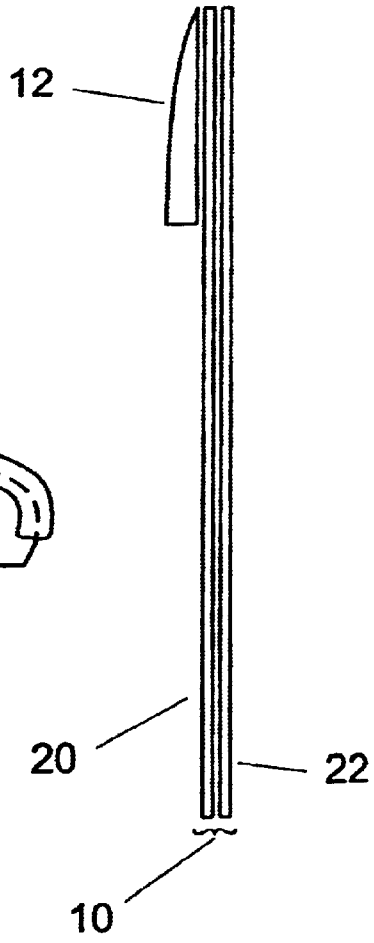
FIG. 4 shows the construction of the waterproof/breathable, hydrophobic, non-absorbent laminate material.

FIG. 4 shows the construction of the laminate material used to make the protective seat cover. A hydrophobic, non-absorbing layer 22 could be attached to a water-impermeable/gas-permeable layer 20 using various methods such as sewing, adhesives, heat, ultrasound or other method of attachment. The top surface of the material would be hydrophobic and non-absorbent. The hydrophobic, non-absorbing layer 22 would be the top layer of the seat cover and would go next to the user. The waterproof/breathable layer 20 would be the back layer of the seat cover and would go next to the seat. The hydrophobic, non-absorbing layer 22 could be treated with an anti-microbial agent as previously described. In an alternative embodiment an absorbent material could be used instead of a hydrophobic, non-absorbing material.

ADVANTAGES

From the description above, a number of advantages of the seat cover become apparent:

a) Because the seat cover is waterproof the underlying seat will not be impacted by a user who is wet or sweaty or by liquids which are spilled onto the seat cover. Likewise, the user of the seat cover will not become wet from any moisture that may be under the seat cover.

b) Because the seat cover contains a hydrophobic, non-absorbing material, sweat or moisture will not be absorbed into the seat cover so that it will be quick drying and will resist odors by not providing the opportunity for odor-causing bacteria to form.

c) Because the seat cover contains a hydrophobic, non-absorbing material, sweat or moisture will not be absorbed into the seat cover material so that it dries as quickly as possible and will remain comfortable.

d) Because the seat cover contains a hydrophobic, non-absorbing material, sweat or moisture will not be absorbed into the seat cover material so that the seat cover will not require laundering even after frequent and numerous exposures to sweat or moisture.

e) Since the material is gas-permeable it will make the seat cover more comfortable. It will also allow water vapor to escape from the seat cover if it is folded for storage, which will prevent odors.

f) The shape of the seat cover will allow it to be very adaptable to fitting a wide variety of sitting or lying surfaces.

g) The pocket in the seat cover will allow it to be attached to the back or headrest of a seat. This will help keep the seat cover in place while making it very easy to install and remove.

h) The angular design 11 of the top of the seat cover will provide a better fit for the majority of automotive bucket style seats. The angular design also makes the seat cover safer by not having extra material that could interfere with the driver of the car either through a physical obstruction or a visual obstruction.

i) The seat cover will be very easy to clean if it becomes dirtied or splattered with mud or other contaminants as it can be easily removed from the seat and then washed using a home or commercial washing machine.

j) The front of the seat cover will provide a ready surface for the application of various indicia, logos or graphic images that could be used for personalization of the seat cover or for promotional or advertising purposes.

OPERATION

To use the seat cover the user will open the pocket 12 and slip the pocket 12 over the headrest 18 and the top of the seat back 14. The user will then position the seat cover 10 over the front portion of the seat back 14 and the top of the seat cushion 16.

To remove the seat cover the user will lift the seat cover off of the seat.

The seat cover may be either folder, rolled or bunched for storage while not being used.

CONCLUSIONS, RAMIFICATIONS, AND SCOPE

The reader will see that the waterproof/breathable, hydrophobic, non-absorbent seat cover of this invention is made of a superior material that will yield many advantages over existing seat covers. Because the seat is made of a waterproof material it will provide superior protection to the seat. Because the seat is made of gas-permeable material it will be comfortable for the user and will allow moisture to dissipate during storage. The seat cover will resist odors because it is made of hydrophobic and non-absorbent material and because it may be treated with an anti-microbial agent. The seat cover of this invention will be very easy and cost effective to manufacture because it can be made of laminate material. This laminate material can be pre-made so that it is not necessary to bond multiple layers together during manufacture of the seat cover.

The seat cover is very easy to use. It may be installed and removed in seconds. Also the seat cover can be used on a wide variety of seats and surfaces including car seats, chairs, sofas, lawn chairs, beds as well as the ground.

Although the description above contains many specifics, these should not be construed as limiting the scope of this invention but as merely providing illustrations of some of the presently preferred embodiments of this invention. For example, the seat cover could have other shapes either for functional improvement or aesthetic design. The seat cover could provide for different attachment methods for securing the seat cover to the seat such as snaps, hook and loop fasteners, straps, buckles, or elastic. The seat cover could be made of more than two layers to provide additional functionality and the layers could be combined in a different order. The seat cover could be made to cover the majority of the seat cushion and seat back including the sides of the seat cushion and seat back. The seat cover could be made in a manner that would allow the seat cover to remain in position in a semi-permanent condition; the overall shape of the seat cover could be changed to allow it to be more specifically designed for other types of seating such as furniture or bench style car seats. The seat cover could be made using a stretchable or non-stretchable fabric.

Therefore the scope of this invention should be determined by the appended claims and their legal equivalents, rather than by the examples given.

I claim:

1. A nonabsorbing protective cover for a vehicle seat, the vehicle seat comprising a seat portion and a back portion, said nonabsorbing protective cover comprising:

a laminated material comprising a water-impermeable and gas-permeable layer laminated to a non-absorbent non-woven layer, said laminated material being shaped so as to cover the front surface of the back portion of the vehicle seat and the top surface of the seat portion of the vehicle seat, wherein said non-absorbent non-woven layer of said laminated material is placed next to the user of said nonabsorbing protective cover; and means for attaching said nonabsorbing protective cover to the vehicle seat, whereby said nonabsorbing protective cover resists absorption of liquid contaminants from the user, hydrophobically repels liquid contaminants introduced thereto, protects the vehicle seat from damage therefrom.

2. The nonabsorbing protective cover as defined in claim 1 wherein said attachment means comprises a pocket formed at an upper end of said nonabsorbing protective cover, wherein said pocket fits over the top of the back portion of the vehicle seat and retains said upper end of said nonabsorbing protective cover on the back portion of the vehicle seat.

* * * * *

UNITED STATES PATENT AND TRADEMARK OFFICE

CERTIFICATE OF CORRECTION

PATENT NO. : 6,655,735 B1
DATED : December 2, 2003
INVENTOR(S) : Leaming, Thomas W.

It is certified that error appears in the above-identified patent and that said Letters Patent is hereby corrected as shown below:

Title page,
Item [76], Inventor, please delete "Learning" and insert -- Leaming --.

Signed and Sealed this

Twenty-seventh Day of April, 2004

JON W. DUDAS
*Acting Director of the United States Patent and Trademark Office*